US007493188B2

(12) United States Patent
Minakata et al.

(10) Patent No.: US 7,493,188 B2
(45) Date of Patent: Feb. 17, 2009

(54) YARN FEEDER OF WEFT KNITTING MACHINE

(75) Inventors: Katsuji Minakata, Wakayama (JP); Hirokazu Nishitani, Wakayama (JP); Yoshiyuki Komura, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 11/793,053

(22) PCT Filed: Dec. 12, 2005

(86) PCT No.: PCT/JP2005/022781

§ 371 (c)(1),
(2), (4) Date: Jun. 15, 2007

(87) PCT Pub. No.: WO2006/064767

PCT Pub. Date: Jun. 22, 2006

(65) Prior Publication Data

US 2008/0148782 A1 Jun. 26, 2008

(30) Foreign Application Priority Data

Dec. 16, 2004 (JP) ..... P2004-365001

(51) Int. Cl.
*G06F 19/00* (2006.01)

(52) U.S. Cl. ..... 700/141; 66/125 R

(58) Field of Classification Search ..... 66/125 R, 66/126 R, 127, 132 R, 138; 700/141, 132
See application file for complete search history.

(56) References Cited

U.S. PATENT DOCUMENTS 4,752,044 A 6/1988 Memminger et al.

(Continued)

FOREIGN PATENT DOCUMENTS

JP 2541574 10/1996

(Continued)

OTHER PUBLICATIONS

International Search Report (PCT/ISA/210).

*Primary Examiner*—Danny Worrell
(74) *Attorney, Agent, or Firm*—Harness, Dickey & Pierce, P.L.C.

(57) ABSTRACT

An object of at least one embodiment of the present invention is to stably feed a yarn by suppressing the effect of inertia in a buffer mechanism provided in a yarn feeding path. In at least one embodiment, a yarn feeder of the weft knitting machine feeds a knitting yarn from either of ends of a needle bed through a yarn feeding member to a knitting needle which carries out knitting motion based on knitting data while reciprocating the yarn feeding member in a longitudinal direction of the needle bed. A buffer rod is provided in the feeding path for the knitting yarn. Before the yarn feeding member starts to feed the knitting yarn to the knitting needle. a yarn feed controller carries out control to feed out the yarn to the buffer rod beforehand in a moving direction in which the feeding path is extended and to pull back the yarn stored in the buffer rod in a moving direction in which the feeding path is reduced. Thus, since an overshoot and an undershoot by the effect of inertia is caused by the buffer rod provided in the feeding path for the knitting yarn can be suppressed, the knitting yarn can be stably fed.

5 Claims, 9 Drawing Sheets

U.S. PATENT DOCUMENTS

| | | | | |
|---|---|---|---|---|
| 6,010,052 | A * | 1/2000 | Leins et al. | 226/44 |
| 6,170,301 | B1 * | 1/2001 | Stoll et al. | 66/126 R |
| 6,550,285 | B2 * | 4/2003 | Nishitani | 66/146 |
| 7,055,349 | B2 * | 6/2006 | Morita et al. | 66/146 |
| 7,218,988 | B2 * | 5/2007 | Morita et al. | 700/141 |
| 7,289,869 | B2 * | 10/2007 | Morita | 700/141 |
| 7,363,101 | B2 * | 4/2008 | Nishitani et al. | 700/141 |
| 2002/0139152 | A1 * | 10/2002 | Nishitani | 66/125 R |
| 2006/0090520 | A1 | 5/2006 | Morita et al. | |
| 2007/0000287 | A1 | 1/2007 | Morita et al. | |

FOREIGN PATENT DOCUMENTS

| | | |
|---|---|---|
| JP | 11-500500 | 1/1999 |
| JP | 2951068 | 9/1999 |
| WO | 2004/009894 | 1/2004 |
| WO | 2005/038116 | 4/2005 |

* cited by examiner

YARN FEEDER
36
34
33a
33b
33c
33z
34a
34b
34c1
34c2
32
44a
44b
44c
44z
KNITTED FABRIC
KNITTING WIDTH
ROD ANGLE
0
YARN SPEED
0
txa
txx
txb
txc
TIME

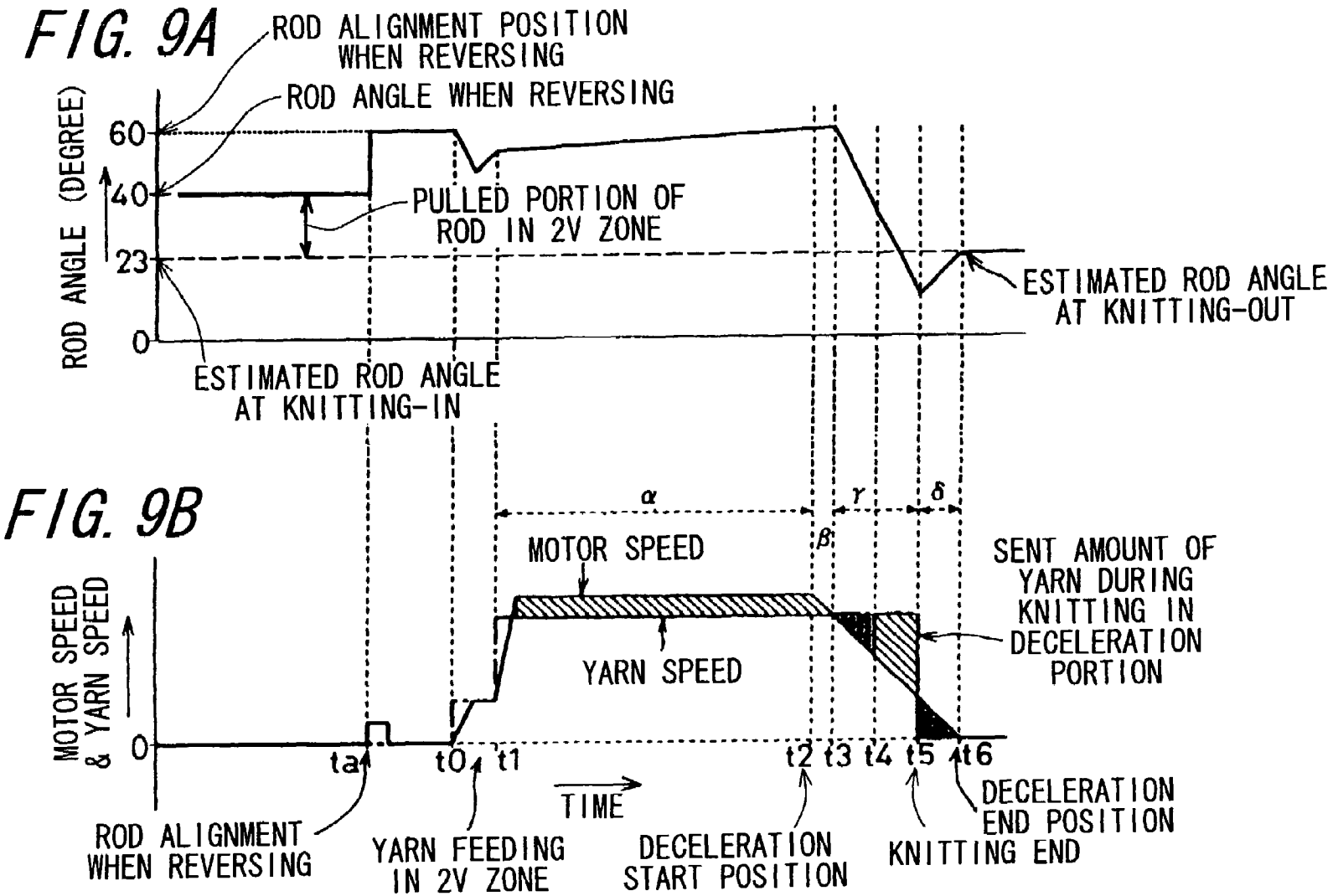
FIG. 9A
ROD ALIGNMENT POSITION WHEN REVERSING
ROD ANGLE WHEN REVERSING
PULLED PORTION OF ROD IN 2V ZONE
ESTIMATED ROD ANGLE AT KNITTING-IN
ESTIMATED ROD ANGLE AT KNITTING-OUT
ROD ANGLE (DEGREE)
60
40
23
0
FIG. 9B
MOTOR SPEED & YARN SPEED
0
ROD ALIGNMENT WHEN REVERSING
ta
YARN FEEDING IN 2V ZONE
t0
t1
MOTOR SPEED
YARN SPEED
α
β
γ
δ
SENT AMOUNT OF YARN DURING KNITTING IN DECELERATION PORTION
t2
DECELERATION START POSITION
t3
t4
t5
KNITTING END
t6
DECELERATION END POSITION
TIME

YARN FEEDER OF WEFT KNITTING MACHINE

TECHNICAL FIELD

The present invention relates to a yarn feeder of a weft knitting machine with which a length of a fed knitting yarn for knitting a knitted fabric can be controlled in accordance with knitting data.

BACKGROUND ART

Conventionally, a weft knitting machine is provided with a yarn feeder mounted, for example, on a side cover on one end side in a longitudinal direction of a needle bed so that a knitting yarn is fed from a yarn feeding port of a yarn feeding member to a knitting needle when knitting a knitted fabric. The yarn feeder comprises a buffer rod to have a function of temporally storing a knitting yarn, and a function of applying a tension to the knitting yarn. However, in a conventional yarn feeder with which the knitting yarn is stored and the tension is applied to the knitting yarn within a range of inclination of the buffer rod, a fluctuation in tension of the knitting yarn during knitting is increased.

There has been known a conventional technique in which a tension is applied to a knitting yarn by using a member corresponding to the buffer rod in the conventional yarn feeder, and a margin is allowed for to cope with a sudden fluctuation in tension of the knitting yarn, to thereby suppress the fluctuation in tension of the knitting yarn while actively feeding out the knitting yarn (refer to Japanese Examined Patent Publication JP-B2 2541574, for example). In addition, there has been known a conventional technique in which rotation of a spinning wheel for feeding a knitting yarn is controlled prior to a sudden change in demand for the knitting yarn, to thereby suppress a fluctuation in yarn tension without using a member corresponding to the buffer rod (refer to Japanese Unexamined Patent Publication JP-A 11-500500 (1999), for example).

The applicant discloses a technique in which a knitting yarn necessary for knitting is fed while consumption of the knitting yarn is calculated based on knitting data of a knitted fabric (refer to WO 2004/009894, for example). In WO 2004/009894, a yarn feeder 16 as shown in FIG. 8 is used. The yarn feeder 16 includes a main roller 20, a sub-roller 21, and a servo motor 22. The main roller 20 is mounted on a rotating shaft of the servo motor 22, and rotating force of the servo motor 22 is transmitted to the sub-roller 21 through a driven mechanism which is constituted by combining a plurality of gears. The main roller 20 and the sub-roller 21 are arranged so as to nip a knitting yarn 4, and the sub-roller 21 is rotationally driven at a circumferential speed equal to that of the main roller 20.

The knitting yarn 4 is fed from above a frame of the weft knitting machine, and guided to a portion in which the sub-roller 21 is opposed to the main roller 20 while keeping in contact with an outer circumferential surface of the main roller 20. A small clearance is formed between the outer circumferential surface of the main roller 20 and that of the sub-roller 21, through which the knitting yarn 4 passes. The knitting yarn 4 is further guided to an intermediate roller 25, and is oriented to a different direction and pulled to a tip side 9 of the buffer rod 7. A spring which energizes so as to raise the tip side 9 is provided on a base end side 8 of the buffer rod 7. An inclination angle of the buffer rod 7 is defined such that a rod angle becomes a zero degree at a position in which a distance between the tip side 9 and the intermediate roller 25 becomes smallest. The spring swingingly displaces the buffer rod 7 such that the inclination angle becomes small when the tension of the knitting yarn 4 is large, and the inclination angle becomes large when the tension thereof is small. The inclination angle of the buffer rod 7 is detected by an inclination angle sensor 27 which is provided on the base end side 8. The inclination angle of the buffer rod 7 can be changed, for example, in a range of 0 degree to 100 degrees.

FIGS. 9A and 9B show a necessary yarn feeding mode of the yarn feeder 16 shown in FIG. 8. FIG. 9A shows a basic change in the inclination angle in accordance with swinging displacement of the buffer rod 7 which is plotted against time during which a yarn feeding member moves a yarn feeding position with respect to a knitted fabric. In addition, FIG. 9B shows a basic change with respect to a speed of the servo motor 22 in the yarn feeder and a speed that the knitting yarn 4 is fed out to the yarn feeding member, corresponding to movement of the yarn feeding position. The changes of FIGS. 9A and 9B correspond to a case in which one course of the knitted fabric is knitted while the yarn feeding member such as a yarn feeder entrained by a carriage is moving from a side close to the yarn feeder 16 to a side away therefrom. The yarn feeding member starts its movement by use of the carriage at a time to after a rod alignment when reversing has been carried out at a time ta. When the carriage moves at a speed of V, the servo motor 22 is controlled so that the feeding member feeds out the knitting yarn at a yarn speed of 2V which is twice as fast as a carriage speed until the yarn feeding member starts its movement at the time t0 and reaches a reference position at a knitting end of the knitted fabric at a time t1. The knitting yarn required in this 2V zone includes a portion from the tip side 9 of the buffer rod 7 to the yarn feeding member, and a portion from the yarn feeding member to a knitting needle at the knitting end. When the yarn feeding member is entrained by the carriage to move away from the tip side 9 of the buffer rod at a speed of V, it is necessary to feed the knitting yarn at a yarn speed of 2V.

In the conventional yarn feeder, as described above, while the knitted fabric is knitted in the waft knitting machine, an amount of demand for knitting yarn is significantly changed depending on a movement position of the yarn feeding member, and the yarn tension is fluctuated depending on the demand for the knitting yarn. The significant fluctuation in the yarn tension leads to a change in a knitted loop length in a knitting width direction of the knitted fabric, resulting in deterioration in quality of the knitted fabric.

Also in the conventional technique disclosed in JP-B2 2541574, it is difficult to cope with a sudden change in the amount of demand for the knitting yarn which is produced, for example, at an end of the knitted fabric. In the conventional technique disclosed in JP-A 11-500500, it is expected to cope with a sudden change in the amount of demand for the knitting yarn. However, in this conventional technique, it is difficult to stabilize the yarn tension while knitting a fabric because no buffer rod is provided. Further, a slack of the knitting yarn produced when the yarn feeding member has been moved to the yarn feeder side cannot be eliminated. Moreover, it is necessary to wind the knitting yarn around a spinning wheel, thereby increasing a size of the spinning wheel. Weft knitting machines often knit a knitted fabric using a plurality of yarns, and thus such flat knitting machines need to have a yarn feeding mechanism for each yarn. When weft knitting machines include a plurality of yarn feeders each of which uses a large spinning wheel, the flat knitting machines become large.

In a buffering mechanism such as the buffer rod 7 disclosed in WO 2004/009894, it is expected that a sudden change in an amount of demand or supply for the knitting yarn 4 is relieved by its mechanical motion. However, when a yarn speed is increased, the buffer rod 7 is suddenly moved to produce an overshoot and an undershoot due to inertia. For example, when knitting motion of the knitting needle is started, and a stitch cam acts on the knitting needle, a sudden pull-in of the yarn is started, and the knitting yarn 4 is suddenly pulled, so that suddenly the buffer rod 7 is swingingly displaced to a side decreasing a rod angle. When the buffer rod 7 starts its sudden swinging displacement, the buffer rod 7 is swingingly displaced due to the inertia so as to feed the knitting yarn 4 longer than a length with which the knitting yarn 4 is actually pulled, thereby producing an overshoot. Accordingly, a tension of the knitting yarn 4 at that time is reduced. The tension of the knitting yarn 4 is reduced, and thereby an amount of the knitting yarn 4 pulled in by the knitting needle is increased, resulting in a rough knitted loop. Further, when the knitting yarn 4 is loosened, the buffer rod 7 is swingingly displaced to a side increasing the rod angle. When the knitting yarn is suddenly loosened, for example, in a case in which the yarn feeding member starts its movement to the yarn feeder side, the buffer rod 7 cannot keep up with the sudden slack of the knitting yarn, thereby producing an undershoot. Accordingly, the tension of the knitting yarn 4 at that time is reduced. When knitting motion of the knitting needle is started while the undershoot is continued, an amount of the knitting yarn 4 pulled in by the knitting needle is increased, resulting in a rough knitted loop. Thereafter, the buffer rod 7 continues its swinging displacement to a side increasing the rod angle due to the inertia, producing an overshoot to such a direction that the rod angle is increased, instead of being to carry out its swinging displacement to such a direction that the rod angle is decreased in order to feed the knitting yarn 4 to the yarn feeding member side when the knitting motion is started. Accordingly, the tension of the knitting yarn 4 at that time is increased. When the tension of the knitting yarn 4 is increased, clogging that the knitted loop becomes small is produced. When the tension is excessively increased, the knitting yarn 4 may possibly be broken. Such fluctuation in the tension by an effect of the inertia of mechanical parts should be produced when it is attempted to feed the yarn at a higher speed, for example, using the spinning wheel disclosed in JP-A 11-500500.

DISCLOSURE OF INVENTION

An object of the invention is to provide a yarn feeder of a weft knitting machine capable of preventing a sudden motion change in a buffer mechanism provided in a knitting yarn feeding path in order to suppress an effect of inertia and stably feeding a knitting yarn.

The invention provides a yarn feeder of a weft knitting machine which feeds a knitting yarn from either of ends of a needle bed through a yarn feeding member to a knitting needle which carries out knitting motion based on knitting data while reciprocating the yarn feeding member in a longitudinal direction of the needle bed, comprising:

a buffer mechanism provided in a knitting yarn feeding path, capable of storing or pulling out the knitting yarn in a range of a predetermined length, for relieving a sudden demand change of the knitting yarn in association with the knitting motion of the knitting needle;

a knitting yarn feeding mechanism provided on a upstream side of the knitting yarn feeding path of with respect to a yarn feeding direction of the buffer mechanism, for feeding out the knitting yarn to the buffer mechanism; and control means for controlling knitting yarn feeding operation in the knitting yarn feeding mechanism, which control means, in order to relieve a sudden motion change in the buffer mechanism, in a knitting-in zone of a yarn pull knitting, feeds out to the buffer mechanism the knitting yarn having a length pulled out by movement of the yarn feeding member until the knitting yarn is consumed for knitting from a knitting end, from just before the knitting yarn stored in the buffer mechanism is pulled out, in accordance with a movement speed of the yarn feeding member, carries out acceleration and deceleration control of an amount of the knitting yarn which is consumed in the knitting-in zone, from just before the knitting yarn is consumed in following knitting, in accordance with a knitting speed, and thereby feeds out the knitting yarn in the knitting yarn feeding mechanism.

Further, the invention provides a yarn feeder of a weft knitting machine which feeds a knitting yarn from either of ends of a needle bed through a yarn feeding member to a knitting needle which carries out knitting motion based on knitting data while reciprocating the yarn feeding member in a longitudinal direction of the needle bed, comprising:

a buffer mechanism provided in a knitting yarn feeding path, capable of storing or pulling out the knitting yarn in a range of a predetermined length, for relieving a sudden demand change of the knitting yarn in association with the knitting motion of the knitting needle;

a knitting yarn feeding mechanism provided on a upstream side of the knitting yarn feeding path with respect to a feeding direction of the buffer mechanism capable of feeding out the knitting yarn to the buffer mechanism and pulling back the knitting yarn from the buffer mechanism; and control means for controlling knitting yarn feeding operation in the knitting yarn feeding mechanism, which control means, in order to relieve a sudden motion change in the buffer mechanism, in a knitting-in zone of a yarn push knitting, pulls back the knitting yarn stored in the buffer mechanism, having a length moved by the yarn feeding member while the yarn feeding member starts its movement and reaches a knitting end, from just before the yarn feeding member starts its movement, in accordance with a movement speed of the yarn feeding member, thereafter carries out acceleration and deceleration control of an amount of the knitting yarn which is consumed in the knitting-in zone from just before the knitting yarn is consumed for knitting, in accordance with a knitting speed, and thereby feeds out the knitting yarn in the knitting yarn feeding mechanism.

Further, in the invention, it is preferable that the control means feeds out the knitting yarn in the knitting yarn feeding mechanism in order to relieve a sudden motion change in the buffer mechanism, while carrying out acceleration and deceleration control of the amount of the knitting yarn consumed in a knitting-out zone in accordance with the knitting speed in the knitting-out zone.

Further, in the invention, it is preferable that the buffer mechanism further comprises:

a buffer rod for locking a knitting yarn on a tip side thereof in face of the knitting yarn feeding path, the buffer rod being capable of swinging displacement centering around a base end side, for partially pulling out the knitting yarn from the knitting yarn feeding path when the tip side is swingingly displaced to one side, and returning the knitting yarn to the knitting yarn feeding path when the tip side is swingingly displaced to the other side;

a spring for energizing a tip side of the buffer rod and allowing the buffer rod to pull out the knitting yarn by a predetermined length under a predetermined yarn tension; and a sensor for detecting a swinging displacement state of the buffer rod using as a reference an origin which is a position of the tip side when the knitting yarn is pulled out from the knitting yarn feeding path by the predetermined length, and thereby generating a signal representing a detected result wherein the control means controls the knitting yarn feeding mechanism based on the signal generated from the sensor such that a range of swinging displacement of the buffer rod is in a predetermined range.

Further, in the invention, it is preferable that the control means carries out a pattern analysis based on knitting data of the knitted fabric, calculates a theoretical value of a knitted loop length which is knitted with respect to each knitting needle in association with movement of the yarn feeding member, and calculates a feeding speed of the knitting yarn based on the theoretical value.

BRIEF DESCRIPTION OF DRAWINGS

Other and further objects, features, and advantages of the invention will be more explicit from the following detailed description taken with reference to the drawings wherein:

FIG. 9A is a graph illustrating a basic concept of control for achieving a necessary yarn feeding mode in the yarn feeder of FIG. 8; and FIG. 9B is a graph illustrating a basic concept of control for achieving the necessary yarn feeding mode in the yarn feeder of FIG. 8.

BEST MODE FOR CARRYING OUT THE INVENTION

Figure 1:
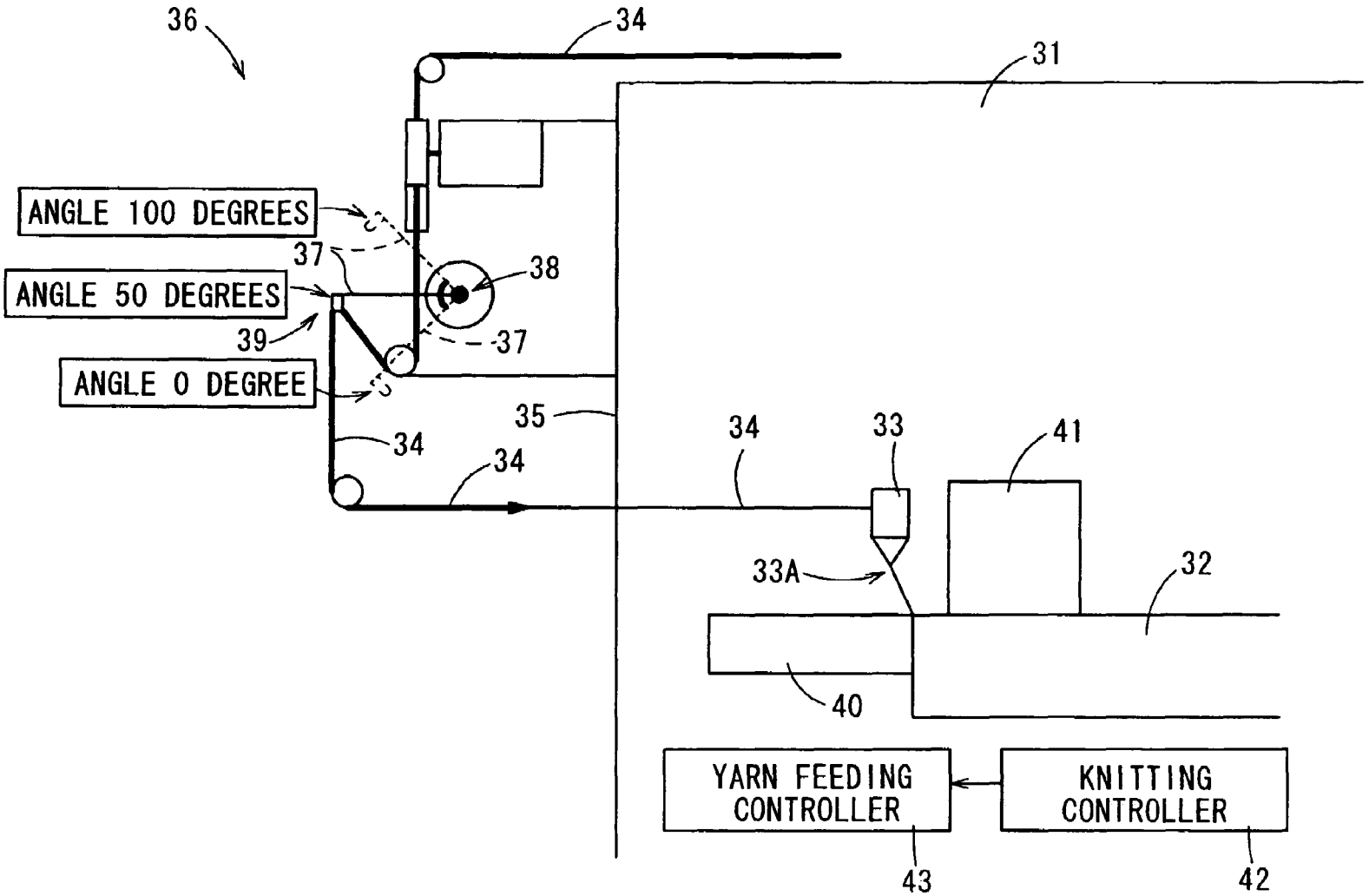
FIG. 1 is a block diagram illustrating a schematic configuration of a yarn feeder 36 of a weft knitting machine 31 according to one embodiment of the invention.

Hereinafter, referring to the drawings, preferred embodiments of the invention will be described in detail.

FIG. 1 shows a schematic configuration of a yarn feeder of a weft knitting machine as one embodiment of the invention. A weft knitting machine 31 feeds a knitting yarn 34 from a yarn feeding port 33A of a yarn feeding member 33 to a knitting needle in order to knit a knitted fabric 32. A yarn feeder 36 for feeding the knitting yarn 34 to the yarn feeding port 33A is provided, for example, on a side cover 35 of the weft knitting machine 31. The yarn feeder 36 is provided in order to suppress a fluctuation in a tension of the knitting yarn 34 and to feed the knitting yarn 34 by an appropriate length corresponding to an amount of demand. The yarn feeder 36 is provided with a buffer rod 37. The buffer rod 37 is capable of swinging displacement around a base end side 38 as a supporting point, energized by a spring in such a direction that a tip side 39 goes away from a surface of the side cover 35, and thereby inclined to have an angle balanced with a tensile force based on the tension of the knitting yarn 34. When the tension of the yarn 34 is increased, the buffer rod 37 is brought into a surface of the side cover 35 against energizing force by the spring, and thereby the knitting yarn 34 having a length corresponding to this swinging range can be fed to the yarn feeding port 33A side.

In the weft knitting apparatus 31, a needle bed 40 for knitting the knitted fabric 32 is linearly provided, and a carriage 41 is reciprocated along the needle bed 40. The needle bed 40 is provided with a number of knitting needles side by side along a moving direction of the carriage 41. A knitting cam is mounted on the carriage 41, which selectively acts on the knitting needles to allow the knitting needles to carry out knitting motion. The carriage 41 carries out the knitting motion of the knitting needles in the needle bed 40 and movement of the yarn feeding member 33 in order to knit the knitted fabric 32. In the automated weft knitting apparatus 31, a knitting controller 42 is provided, and the knitted fabric 32 is knitted in accordance with knitting data prepared in advance.

In the yarn feeder 36 according to the embodiment, a yarn feeding controller is provided so that an amount of demand for the knitting yarn 34 is calculated with respect to each knitting needle according to the knitting data and the knitting yarn is fed out in accordance with the amount of demand. A plurality of modes including a necessary yarn feeding mode, a constant rod angle feeding mode, and an inlay feeding mode are switched by control by the yarn feeding controller 43, for example, based on a relative position between the carriage 41 and the knitted fabric 32. In the necessary yarn feeding mode, while previously calculating a length of the knitting yarn 34 necessary for knitting the knitted fabric 32 according to the knitting motion of the knitting needles based on the knitting data, the knitting yarn 34 having a calculated length is fed out to the yarn feeding member 33. In the constant rod angle feeding mode, the knitting yarn 34 is fed out so that the tip side 39 of the buffer rod 37 maintains its origin position which is a predetermined inclination angle, for example, 50 degrees. In the inlay mode, an amount of yarn necessary for each knitting needle is fed in association with movement of the yarn feeding member 33. Note that the amount of demand for the knitting yarn 34 can be also calculated prior to the knitting. Moreover, a yarn feeding in a 2V zone from a time t0 to a time t1 shown in FIGS. 9A and 9B is carried out basically in the same manner.

When a rod angle of the buffer rod 37 is 100 degrees, an stored amount of the knitting yarn 34 becomes the largest. When an angle of swinging displacement is 0 degree, the stored amount of the knitting yarn becomes the smallest. When a movement speed of the carriage 41 is increased in order to increase production efficiency in the weft knitting machine, it is also necessary to feed the knitting yarn 34 at a higher speed. When the knitting yarn 34 is pulled out from the tip portion 39 of the buffer rod 37 at a high speed, it becomes impossible to ignore an effect of frictional force in the tip portion 39 on a force balance between the knitting yarn 34 and the energizing force by the spring. As a result, the increased yarn speed tends to increase a yarn tension even though the rod inclination of the buffer rod 37 is constant. However, when the yarn speed to pull the knitting yarn 34 to the yarn feeding member 33 side is suddenly increased, the buffer rod 37 is swingingly displaced to such a side that the rod inclination is suddenly decreased, thereby producing an overshoot due to inertia. When the overshoot is produced, the knitting yarn 34 is fed more than an increase in consumption of the knitting yarn 34, thereby decreasing the tension. When energizing force by the spring to the buffer rod 37 is set to a small value so as to be capable of knitting without applying a load, the buffer rod 37 has a tendency to have sudden swinging displacement due to a sudden change in the yarn speed.

Figure 2:
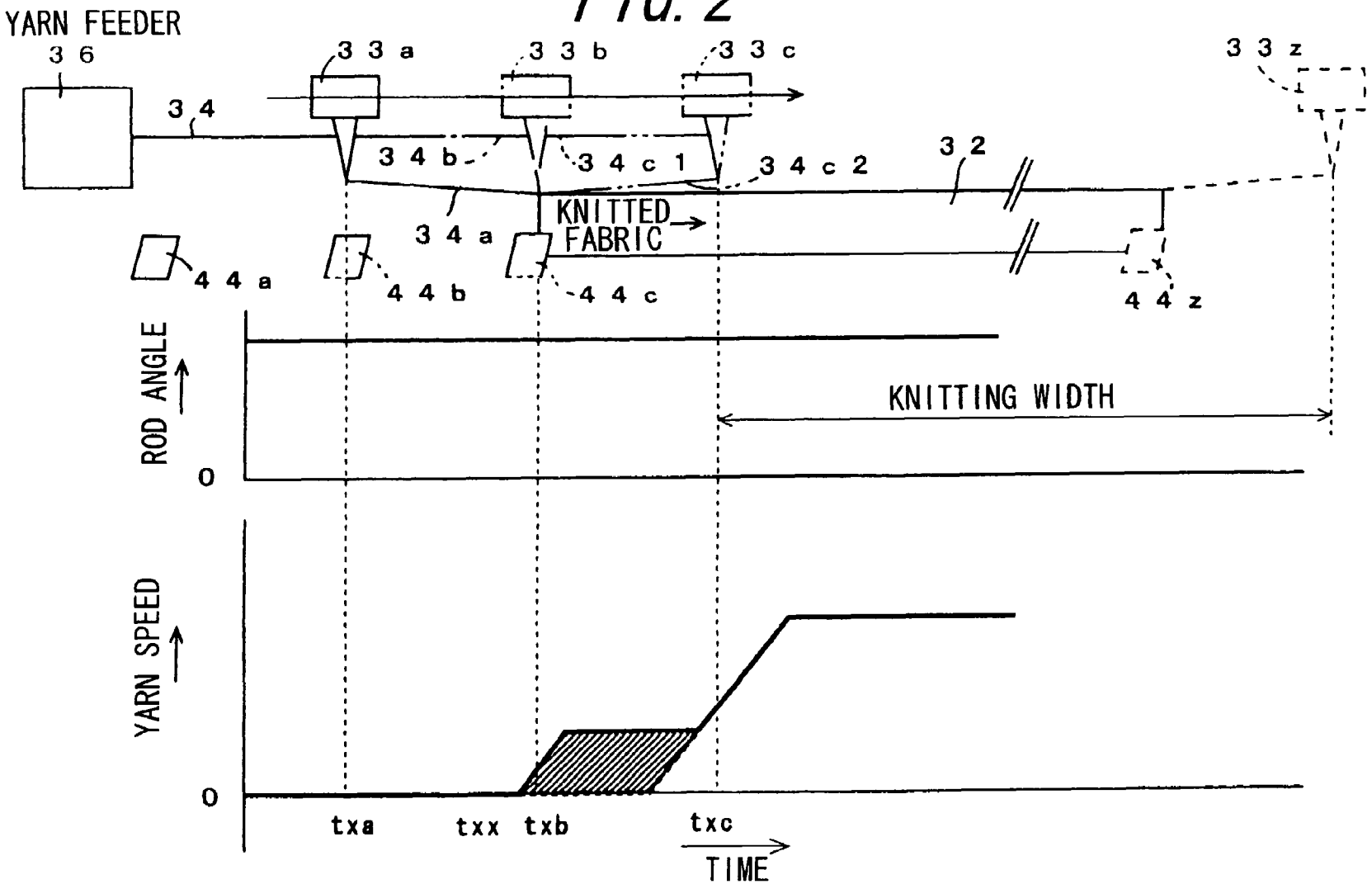
FIG. 2 is a view illustrating a concept of control for suppressing sudden motion of a buffer rod 37 in a knitting-in in which a carriage 41 of FIG. 1 starts to knit a knitted fabric 32 in a yarn pull direction.

FIG. 2 shows a concept of control for suppressing sudden motion of the buffer rod 37 in a knitting-in in which the carriage 41 of FIG. 1 starts to knit the knitted fabric 32 in a yarn pull direction. The knitting controller 42 controls the carriage 41 to entrain a yarn feeding member 33*a* at a time txa, thereby allowing the yarn feeding member 33*a* to start its movement in a direction away from the yarn feeder 36. Note that the yarn feeding member 33*a* at the time txa is situated closer to the yarn feeder 36 than an end of the knitted fabric 32. The knitting yarn 34 extended from the yarn feeder 36 to an end of the knitted fabric 32 includes a portion between the yarn feeder 36 and the yarn feeding member 33*a* and a portion between the yarn feeding member 33*a* and an end of the knitted fabric 32. Here, the portion between the yarn feeding member 33*a* and an end of the knitted fabric 32 is defined as a knitting yarn 34*a*.

The carriage is provided with a cam mechanism for allowing the knitting needles to carry out the knitting motion, and the knitting yarn 34 is fed to the knitting needle by the yarn feeding member 33 in such a state that the knitting needle advances to a needle bed gap by a first-half portion of a needle raising cam included in the cam mechanism. The knitting needle which has advanced to the needle bed gap is pulled down to the needle bed side by a second-half portion of the needle raising cam and a stitch cam. By this pull-down, the knitting yarn 34 is pulled into the needle bed side, and consumed as a knitted loop which constitutes the knitted fabric 32. The stitch cam and the yarn feeding member have a constant position relationship with each other. That is, the carriage is situated at a position indicated by the stitch cam 44*a* in relation to the yarn feeding member 33*a* at the time txa. The knitting yarn is started to be fed to the knitting needle by being entrained by movement of the carriage from a time txb at which the yarn feeding member 33*b* is situated directly above the knitted fabric 32 as shown as a yarn feeding member 33*b* in FIG. 2. However, the stitch cam is situated distant from an end of the knitted fabric 32 even at the time txb as shown as a stitch cam 44*b* in FIG. 2, and a pull-in of the knitting needle is not started. A yarn length of the knitting yarn from the yarn feeding member 33*b* to an end of the knitted fabric 32 is short, and when the knitting yarn from a position shown as the yarn feeding member 33*a* to a position shown as the yarn feeding member 33*b* is defined as a knitting yarn 34*b*, the knitting yarn 34*a* and the knitting yarn 34*b* have substantially the same length.

The 2V zone started from the time t0 shown in FIGS. 9A and 9B is started from the time txb. It is necessary to feed the knitting yarn having a length twice as long as a length from a position of the yarn feeding member 33*b* to a position at which its movement has been completed. When the buffer rod 37 is suddenly swingingly displaced by development of demand for the yarn from the time txb, an overshoot may be possibly produced as described above. In the embodiment, the yarn feeder 36 starts to feed the knitting yarn 34 from a time txx just prior to the time txb. The knitting yarn 34 is fed from the time txx in advance, but a length of the knitting yarn 34 fed till the time txb is a few millimeters. This feeding of the knitting yarn 34 in advance produces a slight slack of the knitting yarn 34, decreasing its tension. At this time, even though the knitting yarn 34 is fed just prior to the time txb by a very slight length of a few millimeters, the buffer rod 37 is not swingingly displaced due to the inertia of the buffer rod 37, thereby preventing a fluctuation in the inclination angle thereof. Hereinafter, feeding of the knitting yarn in the 2V zone as marked with diagonal lines is carried out. Even though demand for the knitting yarn 34 is raised by an actual start of the 2V zone, the demand is absorbed by the slack produced in advance, thereby preventing the fluctuation in the rod angle of the buffer rod 37.

The knitting needle for knitting an end of the knitted fabric 32 is pulled down to the needle bed at a time txc by a position of a stitch cam 44*c* corresponding to a position shown as the yarn feeding member 33*c*. In a period from the time txb to the time txc, it is necessary to feed a knitting yarn 34*c*1 from a position shown as the yarn feeding member 33*b* to a position shown as the yarn feeding member 33*c*, and a knitting yarn 34*c*2 from the yarn feeding position 33*c* to an end of the knitted fabric 32, and this feeding is carried out in the 2V zone marked with diagonal lines. Note that a distance from a position shown as the yarn feeding member 33*c* to a position of a yarn feeding member 33*z* corresponding to a position shown as a stitch cam 44*z* corresponds to a knitting width of the knitted fabric 32.

That is, the yarn feeding controller 43 as control means carries out control for a yarn feeding mechanism such as a servo motor, in a yarn pull knitting in which a knitting yarn feeding path of the knitting yarn 34 is extended in a moving direction of the yarn feeding member 33. In a knitting-in zone in which the yarn feeding member 33 starts to feed the knitting yarn 34 from an end of the knitting width of the knitting yarn 32, control is carried out so that the knitting yarn 34 having a length pulled out by movement of the yarn feeding member 33 until the knitting yarn 34 is consumed for knitting from a knitting end is fed out to the buffer rod 37, from just before the knitting yarn 34 stored in the buffer mechanism such as the buffer rod 37 is pulled out, in accordance with a movement speed of the yarn feeding member 33. In the following knitting, the servo motor is subjected to acceleration and deceleration control so as to feed an amount of yarn consumed in the knitting-in zone from just before the knitting yarn 34 is consumed, in accordance with a knitting speed. The knitting yarn 34 is fed out to the buffer rod 37 in advance before the knitting yarn 34 is suddenly pulled out from the buffer mechanism such as the buffer rod 37, and thereby a sudden motion change of the buffer rod 37 can be relieved. The sudden motion change of the buffer rod 37 is relieved, and thereby an effect of the inertia on a motion of the buffer rod 37 is suppressed, allowing stable feeding of the knitting yarn 34. In the following knitting, the acceleration and deceleration control of the amount of yarn consumed in the knitting-in zone from just before the knitting yarn 34 is consumed is carried out in accordance with a knitting speed, thereby suppressing a fluctuation in the rod angle of the buffer rod 37, or the like.

Figure 3:
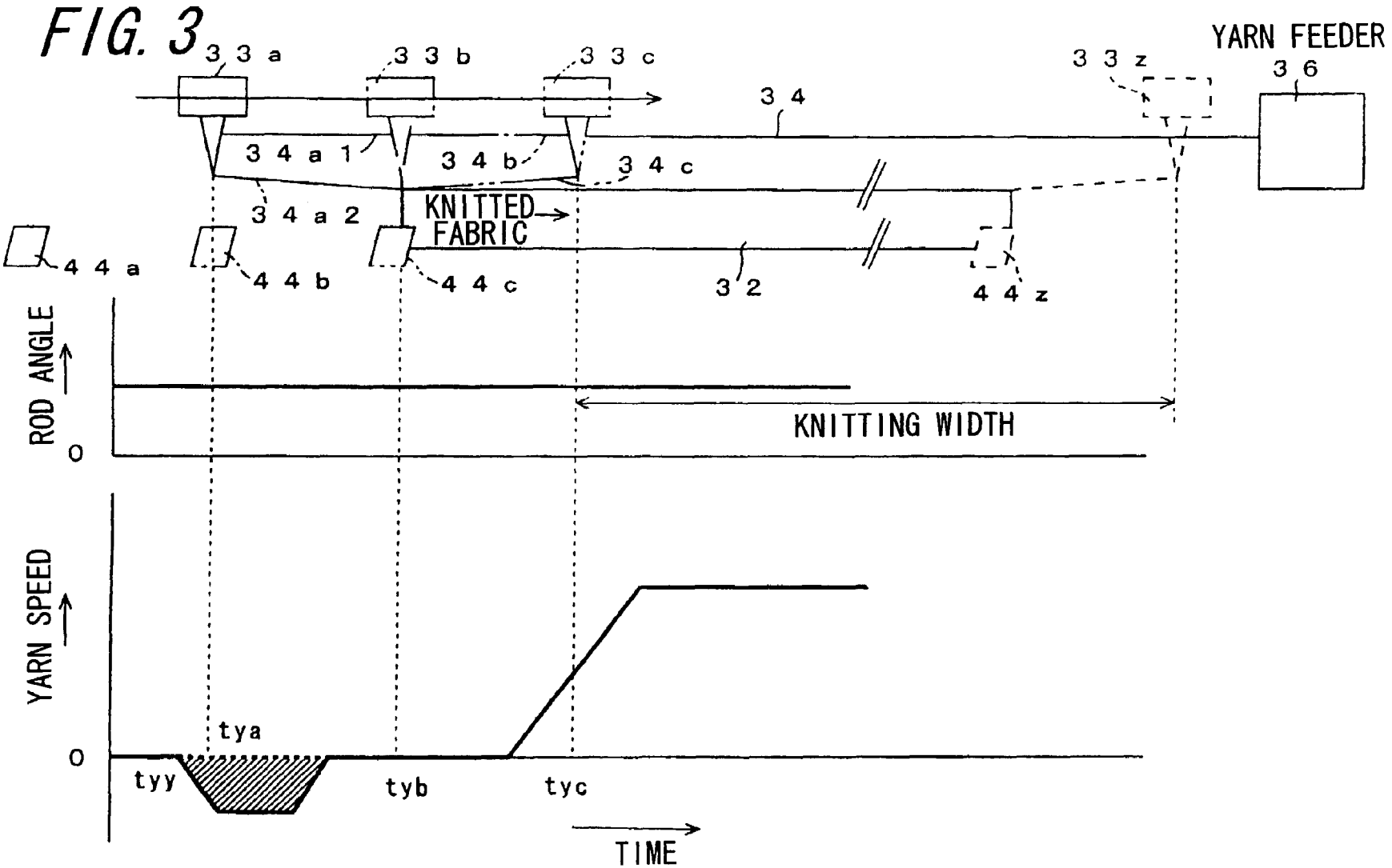
FIG. 3 is a view illustrating a concept of control for suppressing absorbing motion of the buffer rod 37 in a knitting-in in which the carriage 41 of FIG. 1 starts to knit the knitted fabric 32 in a yarn push direction in which the carriage 41 approaches from an end of a side distant from the yarn feeder 36.

FIG. 3 shows a concept of control for suppressing absorbing motion of the buffer rod 37 at a knitting-in at which the carriage 41 of FIG. 1 starts to knit the knitted fabric 32 in a yarn push direction in which the carriage 41 approaches from an end of a side distant from the yarn feeder 36. For convenience of description, a position of the yarn feeder 36 is shown as a different position from the position thereof in FIG. 2. The knitting controller 42 controls the carriage 41 to start its movement in a direction from a position shown as the yarn feeding member 33*a* at a time tya toward the yarn feeder 36. The knitting yarn 34 is not consumed until the yarn feeding member reaches an end of the knitted fabric 32 shown as the yarn feeding member 33*b* at a time tyb. However, in movement approaching the yarn feeder 36 from a position of the yarn feeding member 33*a* to a position of the yarn feeding member 33*b*, movement in which the knitting yarn 34 which has been fed from the yarn feeder 36 is returned to the yarn feeder 36 side is produced. That is, the knitting yarn 34 having a length of a knitting yarn 34*a*1 between a position of the yarn feeding member 33*a* and a position of the yarn feeding member 33*b* plus a knitting yarn 34*a*2 between the yarn feeding member 33*a* and an end of the knitted fabric 32 is left and pushed back to the yarn feeder 36.

The pushed-back of the knitting yarn 34 is absorbed in such a way that the yarn feeding controller 43 controls the servo motor of the yarn feeder 36 in its opposite direction to pull back the knitting yarn as marked with diagonal lines. However, the pushed-back is started at the time tya, as described above, the buffer rod 37 may possibly produce an undershoot and an overshoot, making feeding control of the knitting yarn 34 unstable. The knitting yarn 34 having a length of a few millimeters is returned from the buffer rod 37 to an upstream side in a yarn feeding direction from a time tyy just prior to the time tya, and thereby the knitting yarn 34 is slightly pulled and it is possible to prevent a sudden motion of the buffer rod 37 at the knitting-in. At this time, even though the knitting yarn 34 having a slight length of a few millimeters is pulled back just prior to the time tya, the swinging displacement of the buffer rod 37 is not carried out due to the inertia of the buffer rod 37, and the rod angle thereof is not changed. The knitting yarn 34*b* between a position of the yarn feeding member 33*b* and a position of the yarn feeding member 33*c*, and the knitting yarn 34*c* between the yarn feeding member 33*c* and an end of the knitted fabric 32 have substantially the same length, and thereby it is not necessary to feed the knitting yarn 34. From a time tyc at which the stitch cam 44*c* corresponding to a position of the yarn feeding member 33*c* acts on the knitting needle at an end of the knitted fabric 32 to pull down the knitting needle, the knitting yarn 34 is started to be consumed in association with knitting the knitted fabric 32, and the knitting yarn 34 is fed in accordance with the amount of consumption.

That is, the knitting yarn 34 is fed by control of the servo motor by the yarn feeding controller 43 in a yarn push knitting in which a knitting yarn feeding path of the knitting yarn 34 is reduced in a moving direction of the yarn feeding member 33. In the knitting-in zone in which the yarn feeding member 33 starts to feed the knitting yarn 34 from an end of the knitting width of the knitted fabric 32, the yarn feeding member 33 starts its movement and moves until it reaches a knitting end. The knitting yarn 34 stored in the buffer rod 37 is pulled back from just before the yarn feeding member 33 starts its movement, in accordance with a moving speed of the yarn feeding member 33. Even though the yarn feeding member 33 starts its movement in the yarn push knitting and reduction of the knitting yarn feeding path of the knitting yarn 34 is started, the buffer rod 37 is started to be pulled back. Therefore, a slack of the knitting yarn 34 in the knitting yarn feeding path from the buffer rod 37 to the yarn feeding member 33 is suppressed, and thereby a sudden motion change of the buffer rod 37 can be relieved. The sudden motion change of the buffer rod 37 is relieved, and thereby an effect of the inertia on a motion of the buffer rod 37 is suppressed, allowing stable feeding of the knitting yarn 34. In the following knitting, the acceleration and deceleration control of the amount of yarn consumed in the knitting-in zone from just before the knitting yarn 34 is consumed is carried out in accordance with a knitting speed, thereby suppressing a fluctuation in the rod angle of the buffer rod 37, or the like.

Figure 4:
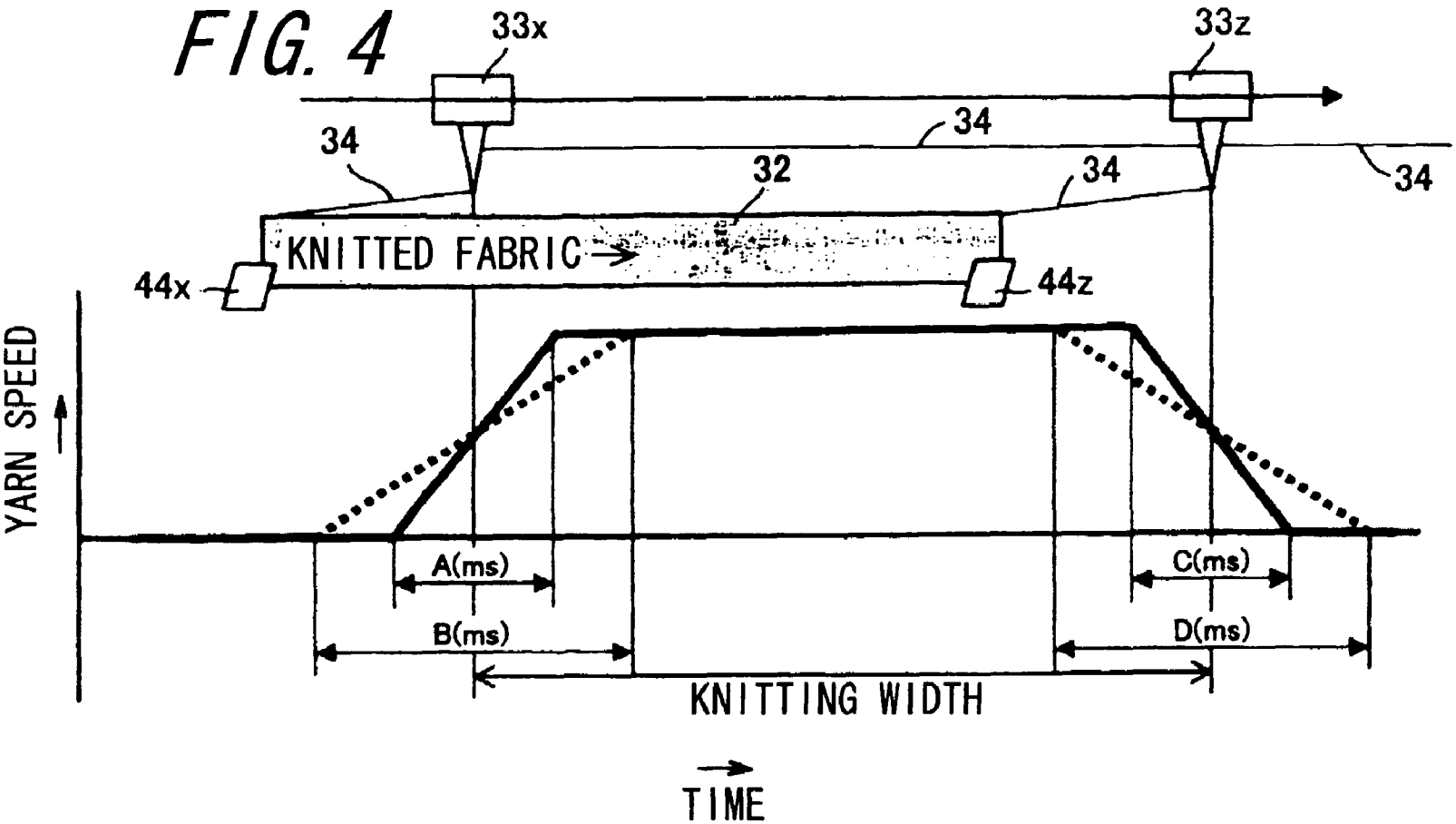
FIG. 4 is a view illustrating a concept of acceleration and deceleration control for a yarn feeding which is set to a yarn feeding controller 43 in the knitting-in and a knitting-out when knitting the knitted fabric 32 of FIG. 1.

FIG. 4 shows a concept of acceleration and deceleration control for a yarn feeding which is set to the yarn feeding controller 43 at the knitting-in and a knitting-out when the knitted fabric 32 is knitted. A feeding speed of the knitting yarn 34 is changed between the knitting-in and the knitting-out, and acceleration and deceleration of the feeding speed may possibly produce a sudden motion of the buffer rod 37. Therefore, time periods for carrying out the acceleration and deceleration control can be set to, for example, a range of A (ms) to B (ms) in the knitting-in, and can be set to, for example, a range of C (ms) to D (ms) in the knitting-out, respectively. When a setting period is increased, a gradient of a yarn speed is decreased, preventing a sudden motion of the buffer rod 37. However, the swinging displacement of the buffer rod 37 is produced, and the tension of the knitting yarn 34 is fluctuated. However, this fluctuation can be suppressed to a smaller range, compared with a fluctuation in a case in which the buffer rod 37 suddenly swings to produce an overshoot.

Both in the yarn-pull knitting as shown in FIG. 3 and in the yarn-push knitting as shown in FIG. 4 in the knitting-out knitting, the acceleration and deceleration control is carried out in a common manner That is, by the yarn feeding controller 43, in the knitting-out zone of a course in which the yarn feeding member 33 slips out of an end of the knitting width of the knitted fabric 32, the knitting yarn 34 is fed out by the servo motor in the yarn feeding mechanism while acceleration and deceleration control of the amount of yarn consumed in the knitting-out zone is carried out in accordance with a knitting speed. Accordingly, a sudden motion change of the buffer rod 37 can be prevented.

Figure 5:
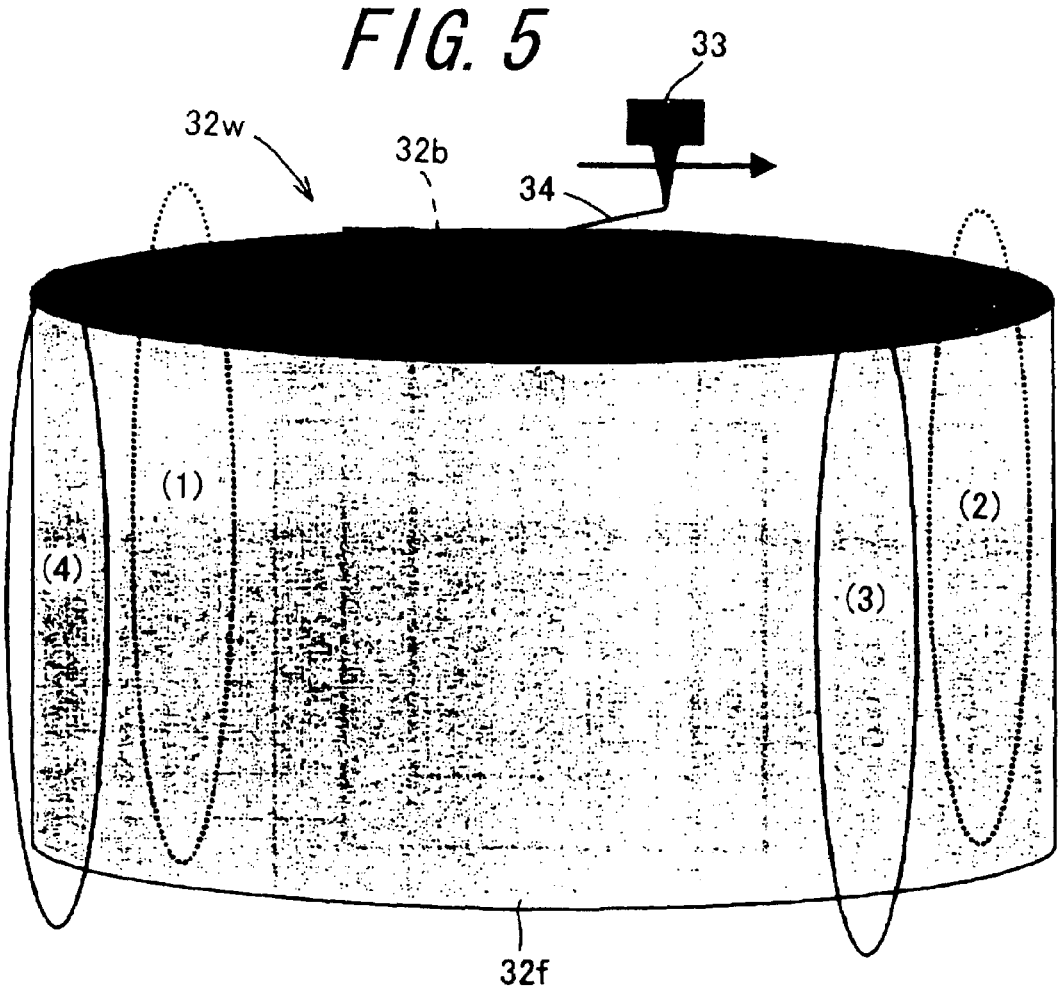
FIG. 5 is a view illustrating control when a weft knitting machine having needle beds backward and forward connects fabrics 32*f* and 32*b* backward and forward with each other at both ends in a width direction thereof in order to knit a knitted fabric 32*w* having a cylindrical shape.

FIG. 5 shows control when a weft knitting machine having needle beds backward and forward connects knitted fabrics 32*f* and 32*b* backward and forward with each other at both ends in a width direction thereof in order to knit a knitted fabric 32*w* having a cylindrical shape. The yarn feeder 36 is provided on a left side of FIG. 5, the knitted fabric 32*f* such as a front body is knitted in a course going to the left in which the yarn feeding member 33 is moved in a left direction, and the knitted fabric 32*b* such as a back body is knitted in a course going to the right in which the yarn feeding member 33 is moved in a right direction. When the knitted fabric 32*b* on a backward side as shown as (1) in FIG. 5 is started to be knitted, a knitting yarn feeding in advance as shown in FIG. 2 and acceleration and deceleration control as shown in FIG. 4 are carried out as a yarn pull knitting-in. When knitting of the knitting yarn 32*b* on a backward side as shown as (2) in FIG. 5 is completed, control for a knitting-out side is carried out by the acceleration and deceleration control as shown in FIG. 4. When the knitted fabric 32*f* on a forward side as shown as (3) in FIG. 5 is started to be knitted, a yarn pull back as shown in FIG. 3 and the acceleration and deceleration control as shown in FIG. 4 are carried out as a yarn push knitting-in. When knitting of the knitting yarn 32*f* on a forward side as shown as (4) in FIG. 5 is completed, control for a knitting-out side is carried out by the acceleration and deceleration control as shown in FIG. 4.

Figure 6:
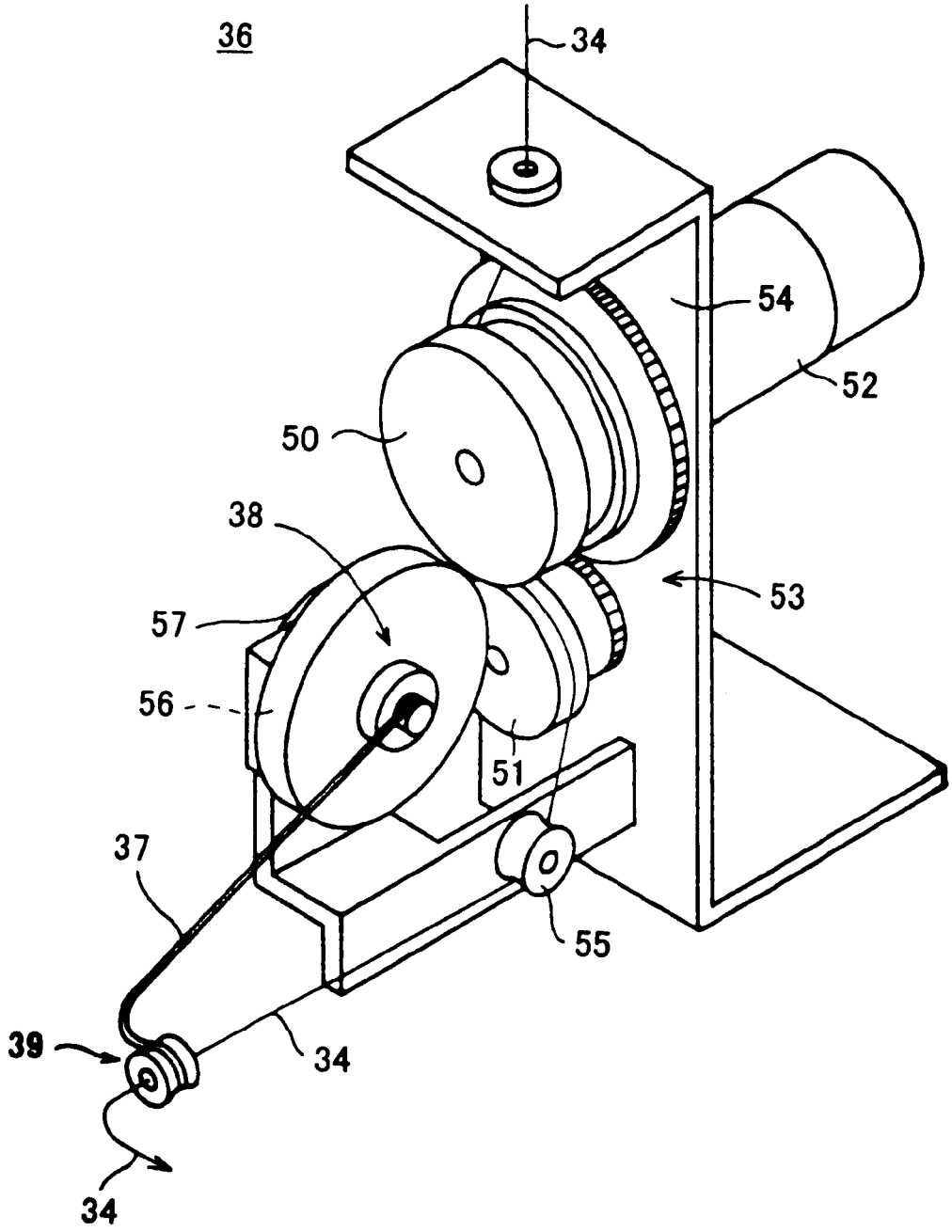
FIG. 6 is a perspective view illustrating a detail configuration of the yarn feeder 36 of FIG. 1.

FIG. 6 shows a detail configuration of the yarn feeder 36. A main roller 50 and a sub-roller 51 are provided in order to feed the knitting yarn 34 to the buffer rod 37. The main roller 50 is attached on a rotating shaft of a servo motor 52. Rotating force of the servo motor 52 is transmitted to the sub-roller 51 through a driven mechanism 53 which is constituted by combining a plurality of gears. The main roller 50 and the sub-roller 51 are arranged so as to nip the knitting yarn 34, and the sub-roller 51 is rotationally driven by the driven mechanism 53 at a circumferential speed equal to that of the main roller 50. The main roller 50, the sub-roller 51, the servo motor 52, and the driven mechanism 53 are mounted on the side cover 35 of FIG. 1 using a frame 54. A diameter of the main roller 50 is small and the sub-roller 51 is arranged below the main roller 50, and thereby one yarn feeder 36 can be configured to have a relatively small width, facilitating arrangement of the plurality of yarn feeder 36 on the side cover 35.

The knitting yarn 34 is fed from above the frame 54, and guided to a portion in which the sub-roller 51 is opposed to the main roller 50 while keeping in contact with an outer circumferential surface of the main roller 50. A small clearance is formed between the outer circumferential surface of the main roller 50 and that of the sub-roller 51, through which clearance the knitting yarn 34 passes. The knitting yarn 34 is further guided to an intermediate roller 55, and is oriented to a different direction and pulled to the tip side 39 of the buffer rod 37. A spring 56 which energizes so that the tip side 39 goes away from a surface of the side cover 35 is provided on the base end side 38 of the buffer rod 37. The buffer rod 37 is swingingly displaced by emerging force by the spring 56 such that an inclination angle becomes small when a tension of the knitting yarn 34 is large, and the inclination angle becomes large when the tension of the knitting yarn 34 is small. The inclination angle of the buffer rod 37 is detected by an inclination angle sensor 57 which is provided on the base end side 38. The inclination angle of the buffer rod 37 can be changed, for example, in a range of 0 degree to 100 degrees.

That is, the buffer rod 37 can be swingingly displaced in a range of 0 degree to 100 degrees with respect to the rod angle as the inclination angle of the buffer rod 37. When the rod angle is at a middle point, a position of, for example, 50 degrees is defined as a rod origin position. When the rod angle is decreased below the rod origin position, the buffer rod 37 becomes in a state of being capable of feeding the stored knitting yarn 34 having a certain length. Moreover, the rod inclination is increased above the rod origin position, the buffer rod 37 becomes in a state of being capable of pulling in the knitting yarn 34 having a certain length. That is, when demand for the knitting yarn 34 is decreased, the tension of the knitting yarn 34 is decreased. Accordingly, energizing force of the spring inclines the buffer rod 37 so that the buffer rod 37 goes away from the side cover 35, thereby increasing the rod inclination. Therefore, an extra length of the knitting yarn 34 is absorbed, that is, is pulled in, thereby preventing a decrease in the tension.

However, only by the swinging displacement of the buffer rod 37, it is impossible to cope with a sudden change in an amount of demand for the knitting yarn 34 which is produced when the knitted fabric 32 is knitted at a high speed using the weft knitting machine 31. In the yarn feeder 36 according to the embodiment, control can be carried out such that a change in the amount of demand for the knitting yarn 34 is predicted using a necessary yarn feeding mode, a fluctuation in the inclination angle of the buffer rod 37 is suppressed, and thereby a fluctuation in the yarn tension of the knitting yarn 34 is suppressed. Moreover, it is possible to suppress a sudden fluctuation of the buffer rod 37 at the knitting-in and the knitting-out and to prevent a sudden fluctuation in the tension of the knitting yarn 34.

Figure 7:
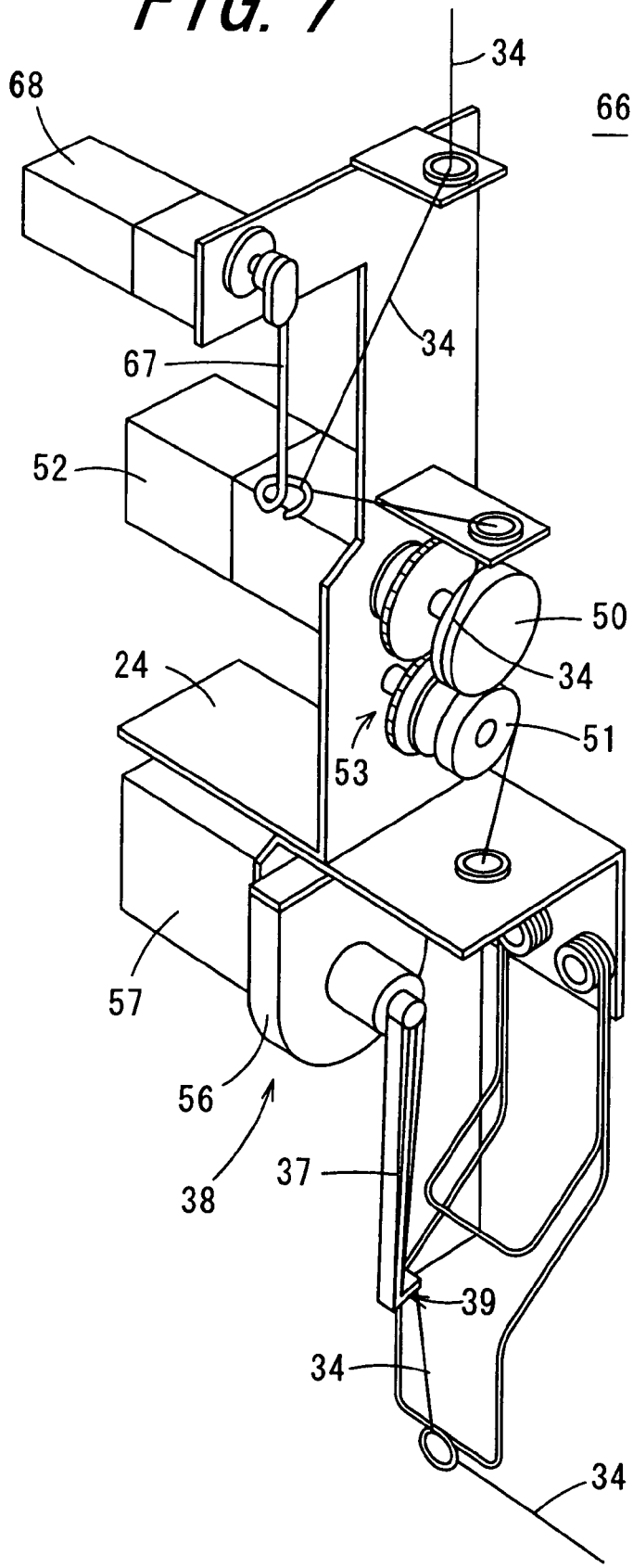
FIG. 7 is a perspective view illustrating a schematic configuration of a yarn feeder 66 as another embodiment of the invention.
Figure 8:
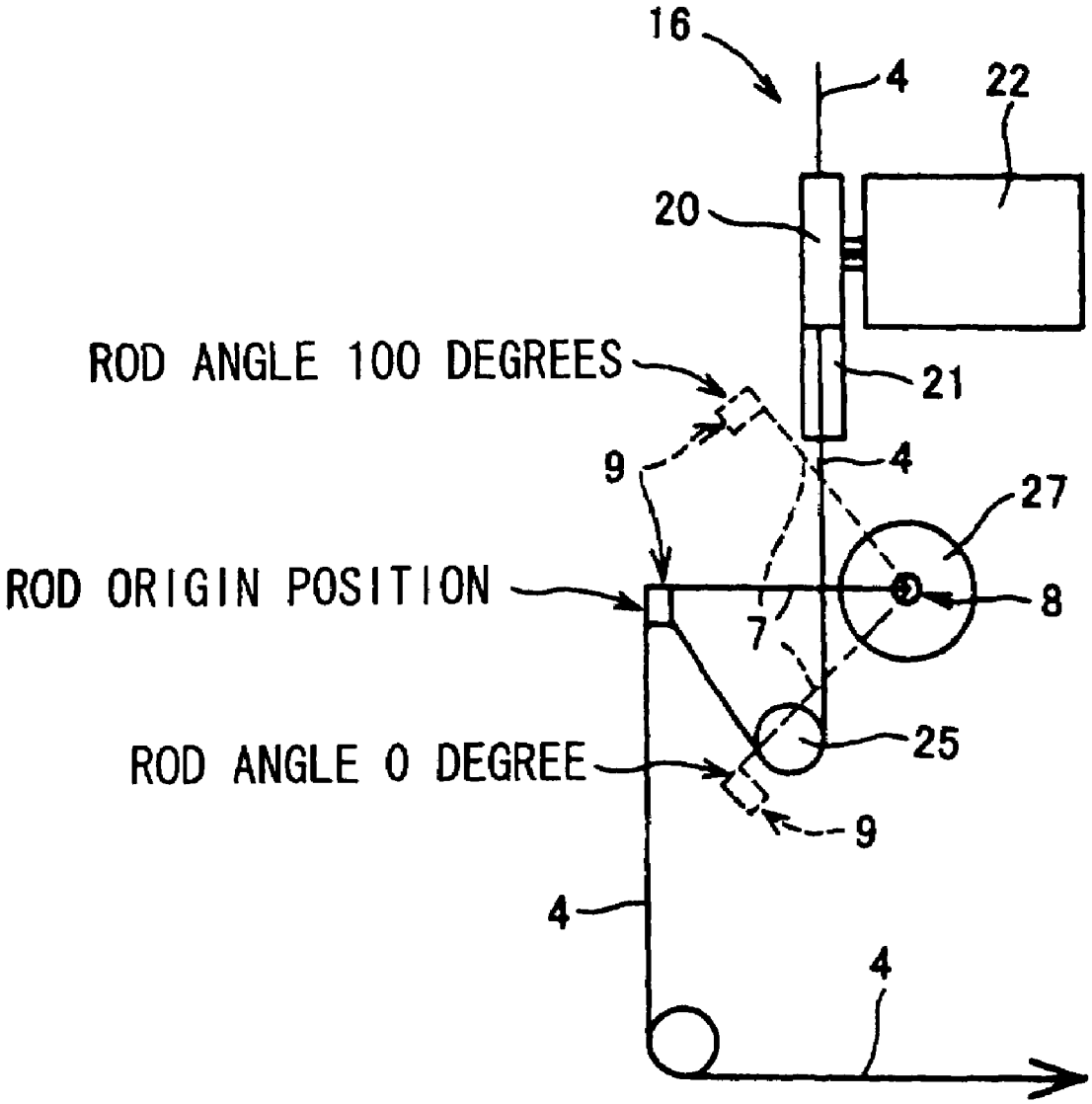
FIG. 8 is a view illustrating a configuration of a conventional yarn feeder.

FIG. 7 shows a schematic configuration of a yarn feeder 66 as another embodiment of the invention. In the configuration, portions corresponding to the yarn feeder 36 of FIG. 6 will be denoted by the same reference numerals and the common description will be omitted in order to prevent overlapped descriptions. In the yarn feeder 66, a rewind arm 67 is provided on an upstream side in a yarn feeding direction of the main roller 50, and a stepping motor 68 is provided on a base end side of the rewind arm 67. Control that the stepping motor 68 is driven by the yarn feeding controller 43 of FIG. 1 is carried out to rotate the servo motor 52 in an opposite direction in the yarn push knitting-in. Accordingly, the knitting yarn 34 can be absorbed even though the knitting yarn 34 is returned.

As described above, the yarn feeders 36 and 66 of the weft knitting machine feed the knitting yarn 31 from either of both ends of the needle bed 40 through the yarn feeding member 33 to the knitting needle which carries out knitting motion based on the knitting data while reciprocating the yarn feeding member 33 in a longitudinal direction of the needle bed 40. As a buffer mechanism, the buffer rod 37 capable of storing or pulling out the knitting yarn 34 in a range of a predetermined length to relieve a sudden demand change of the knitting yarn 34 in association with knitting motion of the knitting needle is provided in the knitting yarn feeding path of the knitting yarn 34. The main roller 50, the sub-roller 51 and the like as the yarn feeding mechanism for feeding out the knitting yarn 34 to the buffer mechanism are provided on an upstream side in a feeding direction of the buffer mechanism in the knitting yarn feeding path of the knitting yarn 34. The yarn feeding controller 43 as control means for controlling feeding motion of the knitting yarn 34 in the yarn feeding mechanism controls depending on whether its moving direction is a direction extending or reducing the knitting yarn feeding path before the yarn feeding member 33 starts to feed the knitting yarn 34 to the knitting needle, such that the knitting yarn 34 is fed out to the buffer mechanism for the knitting yarn 34 in advance in the extending direction and the knitting yarn 34 stored in the buffer mechanism is pulled back in the reducing direction. Therefore, it is possible to suppress an effect of the inertia in the buffer mechanism provided in the knitting yarn feeding path of the knitting yarn 34 and to stably feeding the knitting yarn 34. When the yarn feeding member 33 is moving while feeding the knitting yarn to the knitting needle, it is possible to carry out the acceleration and deceleration control of feeding of the knitting yarn 34 in the yarn feeding mechanism in accordance with a feeding speed of the knitting yarn 34 and to suppress a fluctuation in the buffer mechanism.

Further, the buffer mechanism includes the buffer rod 37, the spring 56, and the inclination angle sensor 57. The buffer rod 37 has the tip side 39 which locks the knitting yarn 34 in face of the knitting yarn feeding path of the knitting yarn 34, and is capable of swinging displacement centering around the base end side 38. When the tip side 39 is swingingly displaced to one side, the knitting yarn 34 can be partially pulled out from the knitting yarn feeding path to store the knitting yarn 34. When the tip side 39 is swingingly displaced to the other side, the knitting yarn 34 can be returned to the knitting yarn feeding path to pull out the stored knitting yarn 34 to the knitting yarn feeding path. The spring 56 energizes the tip side 39 of the buffer rod 37 to pull out the knitting yarn 34 from the knitting yarn feeding path by a predetermined length under a predetermined yarn tension. Therefore, it is possible to apply a tension to the knitting yarn 34 and to prevent a slack of the knitting yarn 34. The inclination angle sensor 57 detects a swinging displacement state of the buffer rod 37 using as a reference an origin that is a position of the tip side 39 when the knitting yarn 34 is pulled out from the knitting yarn feeding path by the predetermined length, thereby generating a signal representing a detected result. Therefore, the swinging displacement state of the buffer rod 37 can be detected by receiving the signal. The yarn feeding controller 43 as the control means controls the yarn feeding mechanism based on the signal generated from the inclination angle sensor 57 so that a range of the swinging displacement of the buffer rod 37 is in a predetermined range. Therefore, a fluctuation in the tension of the knitting yarn 34 can be suppressed.

Further, the yarn feeding controller 34 as the control means carries out a pattern analysis based on the knitting data of the knitted fabric 32, calculates a theoretical value of a knitted loop length which is knitted with respect to each knitting needle in association with movement of the yarn feeding member 33, and calculates a feeding speed of the knitting yarn 34 based on the theoretical value. Therefore, it is possible to carry out control such that motion of the buffer mechanism is properly predicted and a fluctuation is suppressed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention, in a yarn pull knitting in which a knitting yarn feeding path is extended in a moving direction of a yarn feeding member, control in a knitting-in zone in which the yarn feeding member starts to feed a knitting yarn from an end of a knitting width of a knitted fabric is carried out. Control means controls a yarn feeding mechanism to feed out to a buffer mechanism the knitting yarn having a length pulled out by movement of the yarn feeding member until the knitting yarn is consumed for knitting from a knitting end, from just before the knitting yarn stored in the buffer mechanism is pulled out, in accordance with a movement speed of the yarn feeding member. The control means carries out acceleration and deceleration control for the knitting yarn feeding mechanism in accordance with a knitting speed so as to feed an amount of the knitting yarn which is consumed in the knitting-in zone from just before the knitting yarn is consumed in following knitting. The knitting yarn is fed out to the buffer mechanism in advance before the knitting yarn is suddenly pulled out from the buffer mechanism at a knitting-in of the yarn pull knitting, and thereby a sudden motion change in the buffer mechanism can be relieved. The sudden motion change in the buffer mechanism is relieved, and thereby it is possible to suppress an effect of inertia on motion of a portion which stores the knitting yarn in a configuration of the buffer mechanism and to stably feed the knitting yarn. The acceleration and deceleration control of an amount of the knitting yarn which is consumed in the knitting-in zone from just before the knitting yarn is consumed in the following knitting is carried out in accordance with a knitting speed, and thereby a fluctuation in the buffer mechanism can be suppressed.

Further, according to the invention, in a yarn push knitting in which a knitting yarn feeding path is reduced in a moving direction of the yarn feeding member, control in the knitting-in zone in which the yarn feeding member starts to feed the knitting yarn from an end of the knitting width of the knitted fabric is carried out. The control means controls the yarn feeding mechanism to pull back the knitting yarn stored in the buffer mechanism, having a length moved by the yarn feeding member while the yarn feeding member starts its movement and reaches a knitting end, from just before the yarn feeding member starts its movement, in accordance with a movement speed of the yarn feeding member. Even though the yarn feeding member starts its movement in the yarn push knitting and reduction of the knitting yarn feeding path is started, the buffer rod is started to be pulled back. Therefore, a slack of the knitting yarn in the knitting yarn feeding path from the buffer rod to the yarn feeding member is suppressed, and thereby a sudden motion change of the buffer rod can be relieved. The sudden motion change in the buffer mechanism is relieved, and thereby it is possible to suppress an effect of the inertia on motion of a portion which stores the knitting yarn in a configuration of the buffer mechanism and to stably feed the knitting yarn. The acceleration and deceleration control of an amount of the knitting yarn which is consumed in the knitting-in zone from just before the knitting yarn is consumed in the following knitting is carried out in accordance with a knitting speed, and thereby a fluctuation in the buffer mechanism can be suppressed.

Further, according to the invention, the control means feeds out the knitting yarn in the knitting yarn feeding mechanism while carrying out acceleration and deceleration control of the amount of the knitting yarn consumed in a knitting-out zone in accordance with the knitting speed in the knitting-out zone. Therefore, a sudden motion change in the buffer mechanism can be relieved.

Further, according to the invention, a tip side of the buffer rod locks the knitting yarn in face of the knitting yarn feeding path, partially pulls out the knitting yarn from the knitting yarn feeding path when the tip side is swingingly displaced to one side, and thereby the knitting yarn can be stored. When the tip side is swingingly displaced to the other side, the knitting yarn is returned to the knitting yarn feeding path, and thereby the knitting yarn stored can be pulled out to the knitting yarn feeding path. A spring can be adapted to preventa slack of the knitting yarn by adapting a tension to the knitting yarn. By detecting swinging displacement of the buffer rod by a sensor, the control means controls the knitting yarn feeding mechanism so that a range of the swinging displacement of the buffer rod is in a predetermined range, thereby it is possible to suppress a fluctuation in the tension of the knitting yarn.

Further, according to the invention, the control means carries out a pattern analysis based on knitting data of the knitted fabric, calculates a theoretical value of a knitted loop length which is knitted with respect to each knitting needle in association with movement of the yarn feeding member, and calculates a feeding speed of the knitting yarn based on the theoretical value. Therefore, it is possible to carry out control such that motion of the buffer mechanism is properly predicted and the fluctuation is suppressed.

The invention claimed is:

1. A yarn feeder of a weft knitting machine which feeds a knitting yarn through either of ends in a longitudinal direction of a needle bed through a yarn feeding member to a knitting needle which carries out knitting motion based on knitting data while reciprocating the yarn feeding member in the longitudinal direction of the needle bed, comprising:

a buffer mechanism provided in a knitting yarn feeding path, capable of storing or pulling out the knitting yarn in a range of a predetermined length, to relieve a sudden demand change of the knitting yarn based on the knitting motion of the knitting needle;

a knitting yarn feeding mechanism provided upstream of the buffer mechanism in a yarn feeding direction of the knitting yarn feeding path to feed out the knitting yarn to the buffer mechanism; and a controller for controlling knitting yarn feeding operation in the knitting yarn feeding mechanism, in which the controller, in order to relieve a sudden motion change in the buffer mechanism, in a knitting-in zone of a yarn pull knitting, feeds out to the buffer mechanism the knitting yarn having a length pulled out by movement of the yarn feeding member until the knitting yarn is consumed for knitting from a knitting end, from just before the knitting yarn stored in the buffer mechanism is pulled out, in accordance with a movement speed of the yarn feeding member, carries out acceleration and deceleration control of an amount of the knitting yarn which is consumed in the knitting-in zone, from just before the knitting yarn is consumed in following knitting, in accordance with a knitting speed, and thereby feeds out the knitting yarn in the knitting yarn feeding mechanism.

2. A yarn feeder of a weft knitting machine which feeds a knitting yarn through either of ends in a longitudinal direction of a needle bed through a yarn feeding member to a knitting needle which carries out knitting motion based on knitting data while reciprocating the yarn feeding member in the longitudinal direction of the needle bed, comprising:

a buffer mechanism provided in a knitting yarn feeding path, capable of storing or pulling out the knitting yarn in a range of a predetermined length, to relieve a sudden demand change of the knitting yarn based on the knitting motion of the knitting needle;

a knitting yarn feeding mechanism provided upstream of the buffer mechanism in a yarn feeding direction of the knitting yarn feeding path, capable of feeding out the knitting yarn to the buffer mechanism and pulling back the knitting yarn from the buffer mechanism; and a controller for controlling knitting yarn feeding operation in the knitting yarn feeding mechanism, in which the controller, in order to relieve a sudden motion change in the buffer mechanism, in a knitting-in zone of a yarn push knitting, pulls back the knitting yarn stored in the buffer mechanism, having a length moved by the yarn feeding member while the yarn feeding member starts its movement and reaches a knitting end, from just before the yarn feeding member starts its movement, in accordance with a movement speed of the yarn feeding member, thereafter carries out acceleration and deceleration control of an amount of the knitting yarn which is consumed in the knitting-in zone from just before the knitting yarn is consumed for knitting, in accordance with a knitting speed, and thereby feeds out the knitting yarn in the knitting yarn feeding mechanism.

3. The yarn feeder of claim 1, wherein the controller feeds out the knitting yarn in the knitting yarn feeding mechanism in order to relieve a sudden motion change in the buffer mechanism, while carrying out acceleration and deceleration control of the amount of the knitting yarn consumed in a knitting-out zone in accordance with the knitting speed in the knitting-out zone.

4. The yarn feeder of claim 1, wherein the buffer mechanism further comprises:

a buffer rod for locking a knitting yarn on a tip side thereof in face of the knitting yarn feeding path, the buffer rod being capable of swinging displacement centering around a base end side, for partially pulling out the knitting yarn from the knitting yarn feeding path when the tip side is swingingly displaced to one side, and returning the knitting yarn to the knitting yarn feeding path when the tip side is swingingly displaced to the other side;

a spring for energizing a tip side of the buffer rod and allowing the buffer rod to pull out the knitting yarn by a predetermined length under a predetermined yarn tension; and a sensor for detecting a swinging displacement state of the buffer rod using as a reference an origin which is a position of the tip side when the knitting yarn is pulled out from the knitting yarn feeding path by the predetermined length, and thereby generating a signal representing a detected results, wherein the controller controls the knitting yarn feeding mechanism based on the signal generated from the sensor such that a range of swinging displacement of the buffer rod is in a predetermined range.

5. The yarn feeder of claim 1, wherein the controller carries out a pattern analysis based on knitting data of the knitted fabric, calculates a theoretical value of a knitted loop length which is knitted with respect to each knitting needle based on the movement of the yarn feeding member, and calculates a feeding speed of the knitting yarn based on the theoretical value.

* * * * *